US011946667B2

(12) United States Patent
Gaska et al.

(10) Patent No.: US 11,946,667 B2
(45) Date of Patent: Apr. 2, 2024

(54) NOISE SUPPRESION VERTICAL CURTAIN APPARATUS FOR HEAT EXCHANGER UNITS

(71) Applicant: FORUM US, INC., Houston, TX (US)

(72) Inventors: John Gaska, Anacortes, WA (US); Hamid Reza Zareie Rajani, Edmonton (CA); Jonathan Penner, Edmonton (CA); Kevin Visscher, Edmonton (CA)

(73) Assignee: FORUM US, INC., Houston, TX (US)

( * ) Notice: Subject to any disclaimer, the term of this patent is extended or adjusted under 35 U.S.C. 154(b) by 1308 days.

(21) Appl. No.: 16/444,813

(22) Filed: Jun. 18, 2019

(65) Prior Publication Data

US 2020/0400343 A1 Dec. 24, 2020

(51) Int. Cl.
*F24F 13/24* (2006.01)
*F28D 1/02* (2006.01)

(52) U.S. Cl.
CPC ..... *F24F 13/24* (2013.01); *F28D 1/024* (2013.01)

(58) Field of Classification Search
CPC .. F24F 13/24; F24F 1/40; F24F 1/0007; F24F 2265/28; F28D 1/024; F28D 1/0426
USPC ..... 62/239
See application file for complete search history.

(56) References Cited

U.S. PATENT DOCUMENTS

| | | | |
|---|---|---|---|
| 1,833,424 | A | 11/1931 | Jansson |
| 2,060,848 | A | 11/1936 | Boyle |
| 2,273,869 | A | 2/1942 | Julien |
| 2,382,502 | A | 8/1945 | Philipp |
| 2,505,999 | A | 5/1950 | Smith |
| 3,113,634 | A | 12/1963 | Watters |
| 3,207,258 | A | 9/1965 | D'eustachio |
| 3,384,165 | A | 5/1968 | Mathews |
| 3,572,657 | A | 3/1971 | Bradley, Jr. |
| 3,748,997 | A | 7/1973 | Dean, Jr. et al. |
| 3,759,157 | A | 9/1973 | Larkfeldt et al. |
| 3,762,489 | A | 10/1973 | Proksch et al. |
| 3,848,465 | A | 11/1974 | Howell |

(Continued)

FOREIGN PATENT DOCUMENTS

| | | | |
|---|---|---|---|
| CA | 2415575 A1 | 1/2002 | |
| CA | 2746405 A1 * | 11/2012 | ..... F24F 12/006 |

(Continued)

OTHER PUBLICATIONS

Enerflow 3512 frac truck brochure, L&M Radiator Inc., copyright notice dated 2011 (2 pgs).

(Continued)

*Primary Examiner* — Len Tran
*Assistant Examiner* — Gustavo A Hincapie Serna
(74) *Attorney, Agent, or Firm* — Patterson + Sheridan, LLP

(57) ABSTRACT

Aspects of the present disclosure relate generally to noise suppression vertical curtain apparatus for heat exchanger units. In one implementation, a heat exchanger unit includes a frame having a plurality of side regions and at least one cooler associated with at least one of the plurality of side regions. The heat exchanger unit also includes a vertical axis, an internal volume, a floor, and a fan disposed above the floor to move air through the internal volume. The heat exchanger unit also includes a first set of panels disposed between the floor and the fan, and a vertical curtain disposed between the first set of panels and the fan.

23 Claims, 5 Drawing Sheets

(56) References Cited

U.S. PATENT DOCUMENTS 4,116,269 A 9/1978 Keda
4,139,053 A 2/1979 Schaal
4,266,602 A * 5/1981 White ..... H01F 27/33 165/DIG. 313
4,294,595 A 10/1981 Bowerman
4,332,293 A 6/1982 Hiramatsu
4,348,604 A 9/1982 Thode
4,449,664 A 5/1984 Mithuhira et al.
4,481,399 A 11/1984 Greenfield
4,747,275 A 5/1988 Amr et al.
4,821,828 A 4/1989 Schwerzler et al.
4,858,866 A 8/1989 Werner
5,213,152 A 5/1993 Cox
5,238,052 A 8/1993 Chagnot
5,277,655 A 1/1994 Storkan et al.
5,482,113 A 1/1996 Agonafer et al.
5,524,607 A 6/1996 Grohman et al.
5,526,871 A 6/1996 Musser et al.
5,758,860 A 6/1998 Hanazaki et al.
5,879,466 A 3/1999 Creger et al.
5,911,936 A 6/1999 Hanazaki et al.
5,941,303 A 8/1999 Gowan et al.
6,020,737 A 2/2000 Wyss
6,029,345 A 2/2000 Christensen
6,126,681 A 10/2000 Van Duren et al.
6,129,056 A 10/2000 Skeel et al.
6,199,622 B1 3/2001 Mashio et al.
6,240,774 B1 6/2001 Niki et al.
6,286,986 B2 9/2001 Grimland et al.
6,386,273 B1 5/2002 Hateley
6,389,889 B1 5/2002 Ford
6,630,756 B2 10/2003 Kern et al.
6,644,844 B2 11/2003 Neal et al.
6,681,619 B2 1/2004 Alleving et al.
6,736,197 B2 5/2004 Nozaki et al.
6,749,007 B2 6/2004 Ehlers et al.
6,749,901 B1 6/2004 Ghosh et al.
6,880,813 B2 * 4/2005 Yazici ..... F28C 1/10 261/DIG. 11
6,945,355 B2 * 9/2005 Ludwig ..... F16L 55/033 454/262
7,201,254 B2 * 4/2007 Redmann ..... G10K 11/161 181/204
7,210,194 B2 5/2007 Kiem
7,669,485 B2 3/2010 Tang et al.
7,845,413 B2 12/2010 Shampine et al.
7,878,007 B2 2/2011 Campbell et al.
8,087,492 B2 * 1/2012 Cursetjee ..... F24F 8/10 181/258
8,188,698 B2 5/2012 Rollins et al.
8,215,833 B2 7/2012 Kouda et al.
8,336,672 B2 * 12/2012 Derks ..... F16L 55/0336 454/262
8,347,427 B2 1/2013 Klicpera
8,544,531 B2 * 10/2013 Scott ..... F28F 3/022 165/135
8,579,074 B2 * 11/2013 Kosaka ..... F02C 7/045 181/224
8,649,931 B2 2/2014 Nishizawa
8,657,227 B1 2/2014 Bayliss et al.
8,672,089 B2 * 3/2014 Kelly ..... F02B 77/13 181/204
8,764,529 B2 7/2014 Cook et al.
9,103,193 B2 8/2015 Coli et al.
9,109,594 B2 8/2015 Pawlick
9,145,040 B2 9/2015 Markowitz et al.
9,404,417 B2 8/2016 Norrick et al.
9,587,649 B2 3/2017 Oehring
9,945,578 B2 4/2018 Vanberg et al.
9,970,720 B2 5/2018 Vanberg et al.
10,208,983 B2 * 2/2019 Hjorth ..... F24H 3/06
10,281,169 B2 5/2019 Hjorth et al.
10,480,820 B2 * 11/2019 Hjorth ..... F24H 3/06
10,514,205 B2 * 12/2019 Hjorth ..... B01F 35/90
10,557,404 B2 * 2/2020 Tapley ..... F01P 7/10
11,085,439 B2 * 8/2021 Pawlick ..... F01P 3/18
11,306,970 B2 * 4/2022 Klaba ..... F28B 1/06
2002/0074104 A1 6/2002 Dion
2002/0079150 A1 6/2002 Yorwarth et al.
2003/0183446 A1 10/2003 Shah et al.
2003/0192737 A1 10/2003 Han et al.
2004/0053031 A1 3/2004 Beaufils et al.
2004/0200598 A1 10/2004 Hitt et al.
2005/0159846 A1 7/2005 Van Ostrand et al.
2005/0236150 A1 10/2005 Chagnot et al.
2006/0042276 A1 3/2006 Doll et al.
2006/0042278 A1 3/2006 Ludwig et al.
2006/0121101 A1 * 6/2006 Ladizinsky ..... A61K 33/40 424/445
2007/0023172 A1 2/2007 Obrist et al.
2008/0017723 A1 1/2008 Johnson et al.
2008/0065245 A1 3/2008 Tang et al.
2008/0256963 A1 10/2008 Mettier
2009/0219451 A1 9/2009 Birleson et al.
2010/0028134 A1 2/2010 Slapak et al.
2010/0115771 A1 5/2010 Johnson et al.
2011/0066298 A1 3/2011 Francino et al.
2011/0192578 A1 8/2011 Lang et al.
2011/0282619 A1 11/2011 Laursen et al.
2012/0031139 A1 * 2/2012 Shirota ..... F24F 1/0029 62/426
2012/0168113 A1 7/2012 Karamanos
2012/0247712 A1 10/2012 Schertz et al.
2013/0022432 A1 1/2013 Spitler
2014/0008074 A1 1/2014 Nevison
2014/0014426 A1 1/2014 Lauper, Jr. et al.
2014/0056729 A1 2/2014 Pawlick
2014/0262147 A1 9/2014 Pawlick
2014/0345835 A1 11/2014 Hwang et al.
2014/0365195 A1 12/2014 Lahiri et al.
2015/0047811 A1 2/2015 Kappelman et al.
2015/0070007 A1 3/2015 Kurniawan
2015/0251521 A1 9/2015 Brauer et al.
2015/0252661 A1 9/2015 Glass
2015/0343892 A1 12/2015 Kolhouse et al.
2015/0362207 A1 12/2015 Abiprojo et al.
2016/0025536 A1 1/2016 Madsen
2016/0146487 A1 5/2016 Zywiak et al.
2016/0186649 A1 6/2016 Rollinger et al.
2016/0305865 A1 10/2016 Silva et al.
2017/0016649 A1 1/2017 Ace
2017/0096885 A1 4/2017 Oehring et al.
2017/0234631 A1 8/2017 Anderl et al.
2017/0292735 A1 10/2017 Hjorth et al.
2017/0292736 A1 10/2017 Hjorth et al.
2017/0292789 A1 10/2017 Hjorth et al.
2017/0292800 A1 10/2017 Vanberg et al.
2017/0292801 A1 10/2017 Vanberg et al.
2017/0292803 A1 10/2017 Vanberg et al.
2017/0294103 A1 10/2017 Vanberg et al.
2017/0294366 A1 10/2017 Vanberg et al.
2018/0003532 A1 1/2018 Vanberg et al.
2018/0209752 A1 7/2018 Vanberg et al.
2018/0209827 A1 7/2018 Vanberg et al.
2019/0178590 A1 * 6/2019 Vanberg ..... F28F 19/01
2020/0224898 A1 * 7/2020 Zambolin ..... F24F 13/0245
2020/0240713 A1 * 7/2020 Huegele ..... F28D 1/024
2020/0378694 A1 * 12/2020 Chehade ..... F28F 9/266
2021/0062817 A1 * 3/2021 Bauduin ..... F04D 29/522
2021/0063049 A1 * 3/2021 Chakir ..... F28F 9/0075

FOREIGN PATENT DOCUMENTS

CA 2963028 A1 4/2016
DE 10306786 A1 8/2003
WO 2016079674 A1 5/2016

OTHER PUBLICATIONS

World Academy of Science, Engineering and Technology, vol. 6 Nov. 28, 2012, "CFD Modeling of a Radiator Axial Fan for Air Flow Distribution", date of publication indicated as 2012 (6 pgs).

(56) References Cited

OTHER PUBLICATIONS

Canadian Office Action dated Jul. 6, 2018 for Application No. 2,963,572.
Canadian Office Action dated Apr. 26, 2018 for Application No. 2,963,568.
Canadian Office Action dated Feb. 8, 2019 for Application No. 2,969,703.
Canadian Office Action dated Jul. 25, 2018 for Application No. 2,971,746.
Canadian Office Action dated Oct. 12, 2018 for Application No. 2,979,845.
Canadian Office Action dated Nov. 15, 2018 for Application No. 3,022,969.
Canadian Office Action dated Feb. 12, 2019 for Application No. 3,030,718.
International Search Report and Written Opinion dated Jul. 5, 2018 for Application No. PCT/IB2018/052269.
International Search Report and Written Opinion dated Dec. 17, 2018 for Application No. PCT/IB2018/057065.

* cited by examiner

NOISE SUPPRESION VERTICAL CURTAIN APPARATUS FOR HEAT EXCHANGER UNITS

BACKGROUND

Field

Aspects of the disclosure relate generally to noise suppression vertical curtain apparatus for heat exchanger units.

Description of the Related Art

Heat exchanger units generate noise during operation. Depending on the area of operation, the noise may need to be limited, such as below a certain value. Attempts to reduce noise emitted by a heat exchanger unit can limit airflow through the heat exchanger and limit the heat exchange efficiency of the heat exchanger unit. This can result in overheating of equipment used with the heat exchanger unit, and/or an increase in the amount of power used by the heat exchanger unit. These issues can be more severe at high altitudes and low ambient temperatures.

Therefore, there is a need for a heat exchanger unit that emits noise at acceptable levels and has beneficial heat exchange efficiency.

SUMMARY

Aspects of the present disclosure relate generally to noise suppression vertical curtain apparatus for heat exchanger units.

In one implementation, a heat exchanger unit includes a frame having a plurality of side regions and at least one cooler associated with at least one of the plurality of side regions. The heat exchanger unit also includes a vertical axis, an internal volume, a floor, and a fan disposed above the floor to move air through the internal volume. The heat exchanger unit also includes a first set of panels disposed between the floor and the fan, and a vertical curtain disposed between the first set of panels and the fan.

In one implementation, a heat exchanger unit includes a frame having a plurality of side regions and at least one cooler associated with at least one of the plurality of side regions. The heat exchanger unit also includes a vertical axis, an internal volume, a floor, a fan disposed above the floor to move air through the internal volume, the fan having one or more blades. The heat exchanger unit also includes a first set of panels disposed between the floor and the fan, and a vertical curtain disposed between the first set of panels and the fan. The vertical curtain has a top end that is disposed at a distance from the one or more blades of the fan.

In one implementation, a heat exchanger unit includes a frame having a plurality of side regions and at least one cooler associated with at least one of the plurality of side regions. The heat exchanger unit also includes a vertical axis, an internal volume, a floor, and a fan disposed above the floor to move air through the internal volume, the fan having one or more blades. The heat exchanger unit also includes a first set of panels disposed between the floor and the fan, and a second set of panels disposed above the first set of panels and below the fan. Each one of the second set of panels extends vertically from the first set of panels.

BRIEF DESCRIPTION OF THE DRAWINGS

So that the manner in which the above recited features of the disclosure can be understood in detail, a more particular description of the disclosure, briefly summarized above, may be had by reference to implementations, some of which are illustrated in the appended drawings. It is to be noted, however, that the appended drawings illustrate only common implementations of this disclosure and are therefore not to be considered limiting of its scope, for the disclosure may admit to other equally effective implementations.

Figure 1A:
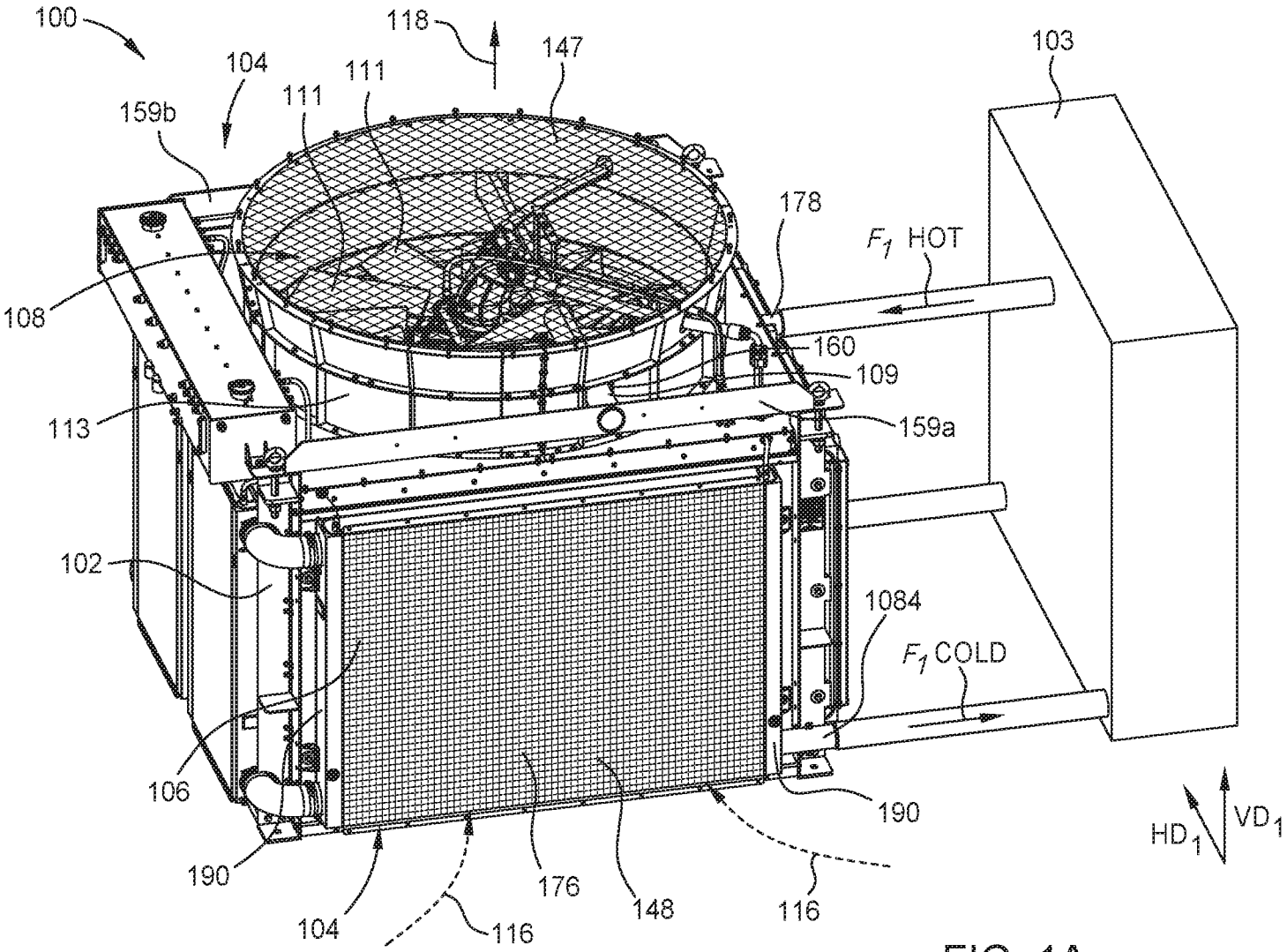
FIG. 1A illustrates a schematic isometric view of a heat exchanger unit, according to one implementation.

To facilitate understanding, identical reference numerals have been used, where possible, to designate identical elements that are common to the FIGURES. It is contemplated that elements disclosed in one implementation may be beneficially utilized on other implementations without specific recitation.

DETAILED DESCRIPTION

Aspects of the disclosure relate generally to noise suppression vertical curtain apparatus for heat exchanger units. FIG. 1A illustrates a schematic isometric view of a heat exchanger unit 100, according to one implementation. The heat exchanger unit 100 includes a frame 102. The heat exchanger unit 100 is fluidly coupled to a heat generating device 103. The heat exchanger unit 100 includes a plurality of coolers 104 and a fan 108 having blades 111. Each of the coolers 104 includes one or more cores 106 configured to exchange heat between a fluid flowing through the cores 106 and air 116 that is moved through the cores 106 by the fan 108. The cores 106 include fins 176. A protective grate 148 may be disposed over the cores 106 to protect the fins 176. In one example, the protective grate 148 is a rock guard. Each of the coolers 104 also includes tanks 190 disposed at opposing ends of each cooler 104.

In one example, a utility fluid $F_1$ is flowing through the cores 106 to exchange heat with the air 116. The utility fluid $F_1$ may be transferred from a heat generating device 103 at a hot temperature ($F_1$ HOT) into an inlet 178, cooled with airflow via one or more cores 106, and transferred out of an outlet 1084 back to the heat generating device 103 at a cooler temperature ($F_1$ COLD). The heat generating device 103 may be an engine, a genset, a motor, a pump, or other comparable equipment that operates in a manner whereby a utility fluid is heated. In one example, the heat generating device 103 is a frac pump or an engine of a frac pump. The utility fluid $F_1$ may include one or more of air, refrigerant, engine coolant, transmission fluid, hydraulic fluid, glycol, fluid lubricant, oil, lubrication oil, engine turbocharger coolant, engine jacket water coolant, engine lubrication oil, and/or water.

Figure 1B:
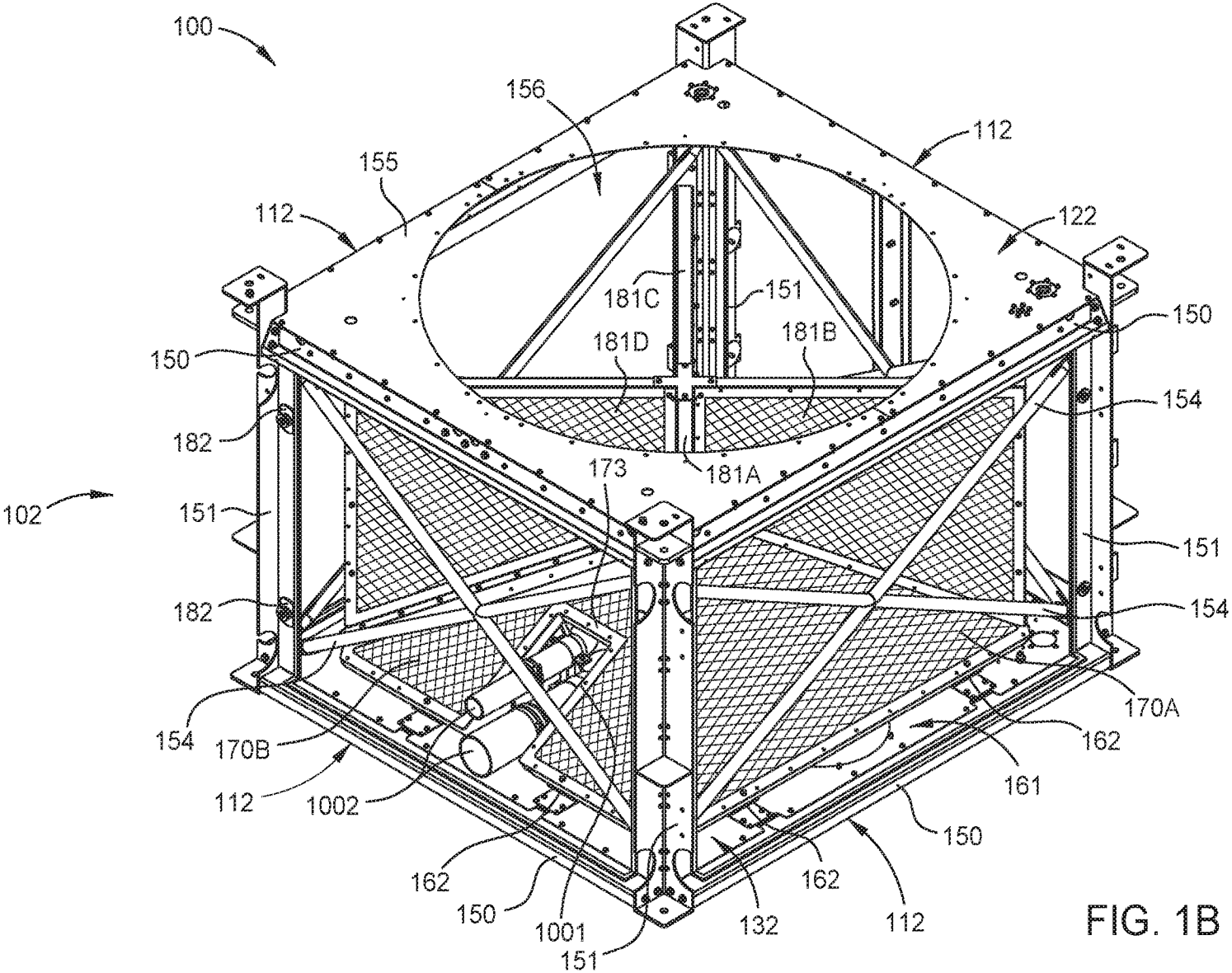
FIG. 1B illustrates a partial schematic isometric view of the heat exchanger unit illustrated in FIG. 1A, according to one implementation.

The fan 108 is disposed adjacent to a top region 122 of the frame 102 (illustrated in FIG. 1B). At least one cooler 104 is disposed adjacent to and associated with at least one of the side regions 112 of the frame 102 (illustrated in FIG. 1B). The frame 102 has four side regions 112, and at least one cooler 104 is disposed adjacent to and associated with each side region 112. Each of the four coolers 104 includes one or more cores 106 (sometimes referred to as "radiator cores").

The fan 108 draws in and directs the flow of air 116 through the heat exchanger unit 100. The air 116 is drawn through the sides of the heat exchanger unit 100 and respective cores 106, which cool one or more utility fluids $F_1$. The air 116 exits the heat exchanger unit 100 as heated exhaust 118. The flow of air 116 through each core 106 is in a horizontal direction, such as horizontal direction $HD_1$. The heated exhaust 118 exits the heat exchanger unit 100 in a vertical direction, such as vertical direction $VD_1$. The fan 108 has an axis of rotation about which the fan 108 is rotated. The axis of rotation of the fan 108 is generally parallel to a vertical axis 127 of the heat exchanger unit 100 (illustrated in FIG. 1C). In one example, airflow through the cores 106 is generally perpendicular to the axis of rotation of the fan 108. Accordingly, airflow through the heat exchanger unit 100 can transition from horizontal to vertical as the airflow moves through the one or more cores 106 and out the heat exchanger unit 100 as heated exhaust 118.

The fan 108 includes a rotating member with a plurality of blades 111 extending from a center of the fan 108. There may be in the range of about 4 to about 16 blades 111 attached in a generally symmetrical manner to the rotating member of the fan 108. The blades 111 are oriented at a blade angle relative to a horizontal axis 126 of the heat exchanger unit (illustrated in FIG. 1C) in the range of about 10 degrees to about 50 degrees. The blade angle of blades 111 may be adjusted to promote optimal and efficient cooling of the heat exchanger unit 100. The blades 111 have an effective blade diameter in the range of about 10 inches to about 100 inches.

The fan 108 is operable by way of a suitable driver, such as a fan motor 1012 (illustrated in FIG. 1C), which may be hydraulic, pneumatic, electrical, gas-powered, etc. The fan motor 1012 may receive power through various power cords or conduits 158. The conduits 158 may be configured for the transfer of pressurized hydraulic fluid or air to and from the fan motor 1012 of the fan 108. As such, pressurized hydraulic fluid may be used to power the fan 108. The pressure of the hydraulic fluid may be in the range of about 2,000 psi to about 6,000 psi. The pressure of the pneumatic fluid may be in the range of 50 to 120 psi. Hydraulic fluid may exit the fan motor 1012 of the fan and be cooled via the heat exchanger unit 100, repressurized, and recirculated back to the fan motor 1012 of the fan 108. The fan 108 operates in the range of about 200 rpm to about 1200 rpm. The fan 108 operates in a manner to provide airflow in the range of about 10,000 cfm to about 300,000 cfm.

FIG. 1B illustrates a partial schematic isometric view of the heat exchanger unit 100 illustrated in FIG. 1A, according to one implementation. The frame 102 of the heat exchanger unit 100 may be an integral body or may include a number of elements arranged and coupled together, such as a plurality of horizontal elements 150 and a plurality of vertical elements 151. Although the shape of the frame 102 is not limited, FIG. 1B illustrates a generally cubical shape where the frame 102 has four side regions 112, a top region 122, and a bottom region 132) that results from the horizontal elements 150 and the vertical elements 151 being connected at various corners and generally perpendicular to one another. A shape of the frame 102 could be cylindrical, hexagonal, or pyramidal. The shape and/or orientation of the horizontal elements 150 and/or vertical elements 151 may vary depending on the shape of the frame 102.

The frame 102 may include one or more frame support plates to facilitate coupling horizontal elements 150 and vertical elements 151 together, as well as providing additional surface area or contact points for which other components may be coupled therewith. One or more frame support plates may have a generally vertical orientation, whereas one or more frame support plates may have a generally horizontal orientation. One or more frame support plates may include a support plate slot or groove.

The horizontal elements 150 and/or vertical elements 151 may include one or more core support mount slots 182 configured to help couple the one or more coolers 104 to the frame 102. There may be a plurality of core support mount slots 182 configured and arranged in a manner such that one or more coolers 104 may be coupled to the horizontal elements 150 and/or the vertical elements 151. One or more coolers 104 having one or more cores 106 may be coupled to the frame 102 with various mounting type assemblies.

The frame 102 includes structural support elements, such as one or more frame support bars 154. The support bars 154 may be coupled between horizontal elements 150 and/or vertical elements 151, such as in a horizontal, vertical, or diagonal manner. In one example, the support bars are oriented in a diagonal manner to form X-shaped configurations (sometimes referred to as "X-braces"). The support bars 154 may be arranged in a "turnbuckle" configuration. The support bar(s) 154 may be coupled to elements in a known manner, such as rivet, weld, nut-and-bolt, etc. The bars 154 may be tubular in shape, which may help improve airflow and reduce pressure drop across the bars 154.

The frame 102 includes a top plate 155 having a top plate opening 156. The top plate opening 156 may be of a shape and size suitable for accommodating airflow through the frame 102. The frame 102 includes a fan guard mount, which may be used for the coupling of a fan guard 147 thereto. The frame 102 may include a fan mount plate to mount the fan 108. The fan mount plate may be connected to a mount bar 109. The mount bar 109 may be a rigid bar or beam that extends from one side 159*a* of the heat exchanger unit 100 to another side 159*b*. The mount bar 109 may be generally cylindrical or tubular shaped, and may be integral to the frame 102 or coupled therewith. In one example, the mount bar 109 is welded or bolted to the frame 102. The mount bar 109 may be suitable to provide a synergistic effect of strength for supporting the fan 108, as well as have smooth surfaces that reduce noise as a result of a decrease in a pressure variation from air flowing over a surface area of the mount bar 109.

The heat exchanger unit 100 includes a fan cylinder assembly 113. The fan cylinder assembly 113 includes an aeroring 123 (sometimes referred to as a "bell"), a center duct 199, and an outlet cone 198. The fan cylinder assembly 113 is annular and is disposed about the fan 108. The fan cylinder assembly 113 is coupled to the frame 102 via connection with the top plate 155. The fan guard 147 is coupled to the fan cylinder assembly 113. The fan cylinder assembly 113 may include one or more lateral openings 160 to accommodate the passing of the mount bar 109 therethrough. The fan cylinder assembly 113 may be positioned with respect to the axis of rotation of the fan 108 such that edges of the blades 111 are extended within manufacturing tolerances between the blades 111 and an inner surface of the center duct 199 of the fan cylinder assembly 113. The fan cylinder assembly 113 may be a unitary piece or the combination of multiple pieces. The size of the fan cylinder assembly 113, including its height and diameter may be varied to accommodate airflow through the heat exchanger unit 100.

Figure 1C:
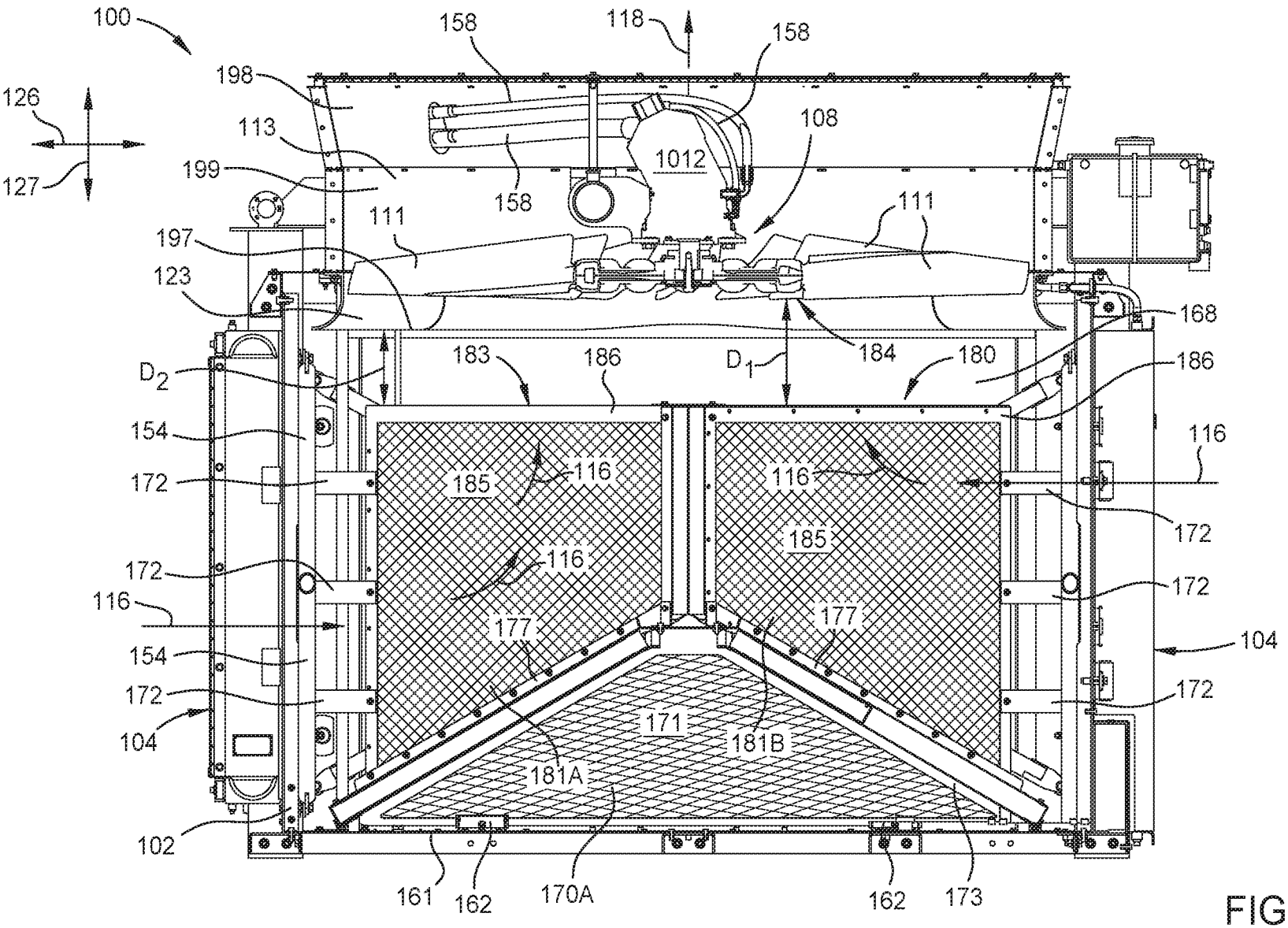
FIG. 1C illustrates a partial schematic side view of the heat exchanger unit illustrated in FIG. 1A, according to one implementation.

The heat exchanger unit 100 includes the aeroring 123 (illustrated in FIG. 1C). The aeroring 123 is annular and has a ring cross-section that has a radius of curvature. The aeroring 123 has a rounded surface that facilitates improving airflow and reducing pressure in and around the fan 108. The aeroring 123 reduces or prevents eddies from occurring in corners of the top of the frame 102. The aeroring 123 includes a bottom surface 197. The heat exchanger unit 100 includes the outlet cone 198. The outlet cone 198 is annular and has a conical cross-section. The outlet cone 198 facilitates improving airflow around the fan motor 1012. The configurations of the aeroring 123, center duct 199, and the outlet cone 198 may provide added ability for further streamlining airflow, which may beneficially reduce overall power requirements for the heat exchanger unit 100.

FIG. 1C illustrates a partial schematic side view of the heat exchanger unit 100 illustrated in FIG. 1A, according to one implementation. The heat exchanger unit 100 includes a floor 161 disposed near the bottom region 132 of the frame 102. The heat exchanger unit 100 includes an internal volume 168. The fan 108 moves air 116 through the coolers 104, through the internal volume 168, and out of the heat exchanger unit 100 as heated exhaust 118. The floor 161 is disposed below the fan 108.

A first set of panels 170A-170D is disposed between the floor 161 and the fan 108. The first set of panels 170A-170D may be mounted to one or more of the frame 102 and/or the floor 161. In one embodiment, which can be combined with other embodiments, each one of the first set of panels 170A-170D is mounted to the floor 161 with one or more mounting brackets 162. The heat exchanger unit 100 includes a vertical curtain 180 disposed above the first set of panels 170A-170D and below the fan 108, between the first set of panels 170A-170D and the fan 108. In one example, the vertical curtain 180 is a noise suppression curtain. The vertical curtain 180 extends upwards from the first set of panels 170A-170D and towards the fan 108. The vertical curtain 180 includes a top end 183 that is disposed at a first distance $D_1$ from a bottom edge 184 of the blades 111 of the fan 108. In one example, the first distance $D_1$ is less than two feet, such as about 1 foot. The top end 183 of the vertical curtain 180 is disposed at a second distance $D_2$ from the bottom surface 197 of the aeroring 123. The second distance $D_2$ is within a range of 0.1 inches to 3.0 inches, such as 1.0 inch to 2.0 inches or 0.8 inches to 1.2 inches. In one embodiment, which can be combined with other embodiments, the second distance $D_2$ is 1.0 inch.

The first distance $D_1$ and second distance $D_2$ values discussed above facilitate uniform airflow through, and thermal efficiency of, the heat exchanger unit 100 while promoting noise absorption.

The vertical curtain 180 includes a second set of panels 181A-181D disposed above the first set of panels 170A-170D and below the fan 108, between the first set of panels 170A-170D and the fan 108. The second set of panels 181A-181D extend upwardly from the first set of panels 170A-170D and towards the fan 108. The vertical curtain 180 and the second set of panels 181A-181D are mounted to one or more of the frame 102 and/or the first set of panels 170A-170D. The vertical curtain 180 and the second set of panels 181A-181D are mounted to one or more vertical elements 151 (illustrated in FIG. 1B) with one or more mounting brackets. Each one of the first set of panels 170A-170D includes a mesh panel 171 and/or a matting enclosed within and connected to a panel frame 173. The mesh panel 171 may be welded, riveted, or bolted to the respective panel frame 173. Each one of the second set of panels 181A-181D of the vertical curtain 180 includes a mesh panel 185 and/or a matting enclosed within and connected to a panel frame 186. The mesh panel 185 may be welded, riveted, or bolted to the respective panel frame 186.

One or more of the first set of panels 170A-170D, such as panel 170B illustrated in FIG. 1B, and/or one or more of the second set of panels 181A-181D can include one or more optional openings 1001 to allow equipment (such as pipes 1002) to pass therethrough.

The panel frames 173, 186 may be connected to one or more of the frame 102 and/or the floor 161. The panel frames 173, 186 may also be connected to each other. In one example, one or more of the panel frames 173 of the first set of panels 170A-170D and/or the panel frames 186 of the second set of panels 181A-181D includes one or more flanges 177 for connecting to other components. The panel frames 173, 86 may be connected to the frame 102, the floor 161, and/or each other using connection devices such as bolts, nuts, pins, screws, welded joints, etc. The panel frames 186 of the second set of panels 181A-181D may be connected to each other.

Figure 1D:
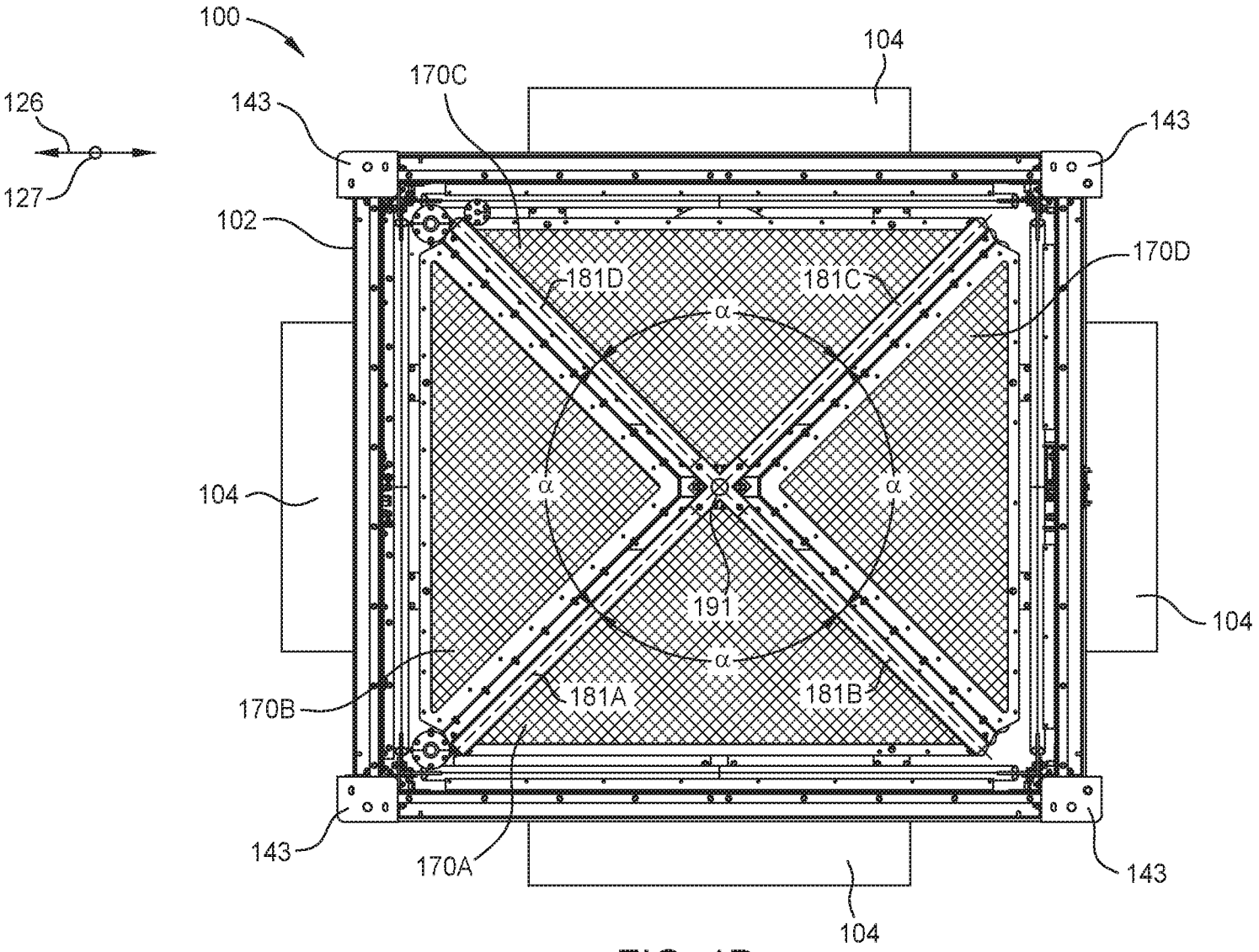
FIG. 1D is a partial schematic top view of the heat exchanger unit illustrated in FIG. 1A, according to one implementation.

FIG. 1D is a partial top schematic view of the heat exchanger unit 100 illustrated in FIG. 1A, according to one implementation. The heat exchanger unit 100 includes a vertical axis 127 and a horizontal axis 126. The first set of panels 170A-170D includes four panels disposed in a pyramidal arrangement (shown in FIGS. 1B-1E). The second set of panels 181A-181D of the vertical curtain 180 includes four panels. The panels of the second set of panels 181A-181D extend radially outwardly from a center 191 of the frame 102 and towards one of four corners 143 of the frame 102. The vertical axis 127 of the heat exchanger unit 100 extends through the center 191.

The panels of the second set of panels 181A-181D are disposed vertically in the internal volume 168 of the heat exchanger unit 100. The panels of the second set of panels 181A-181D are disposed equidistantly from each other in a horizontal plane that is parallel to the horizontal axis 126 of the heat exchanger unit 100. The panels of the second set of panels 181A-181D are disposed at an angle $\alpha$ from each other in a horizontal plane. The angle $\alpha$ is measured between the respective centers of two adjacent panels 181A-181D (such as the respective centers between panel 181A and 181B). The angle $\alpha$ is within a range of 0 degrees to 180 degrees, such as 45 degrees, 60 degrees, 90 degrees, 120 degrees, or 180 degrees.

Figure 1E:
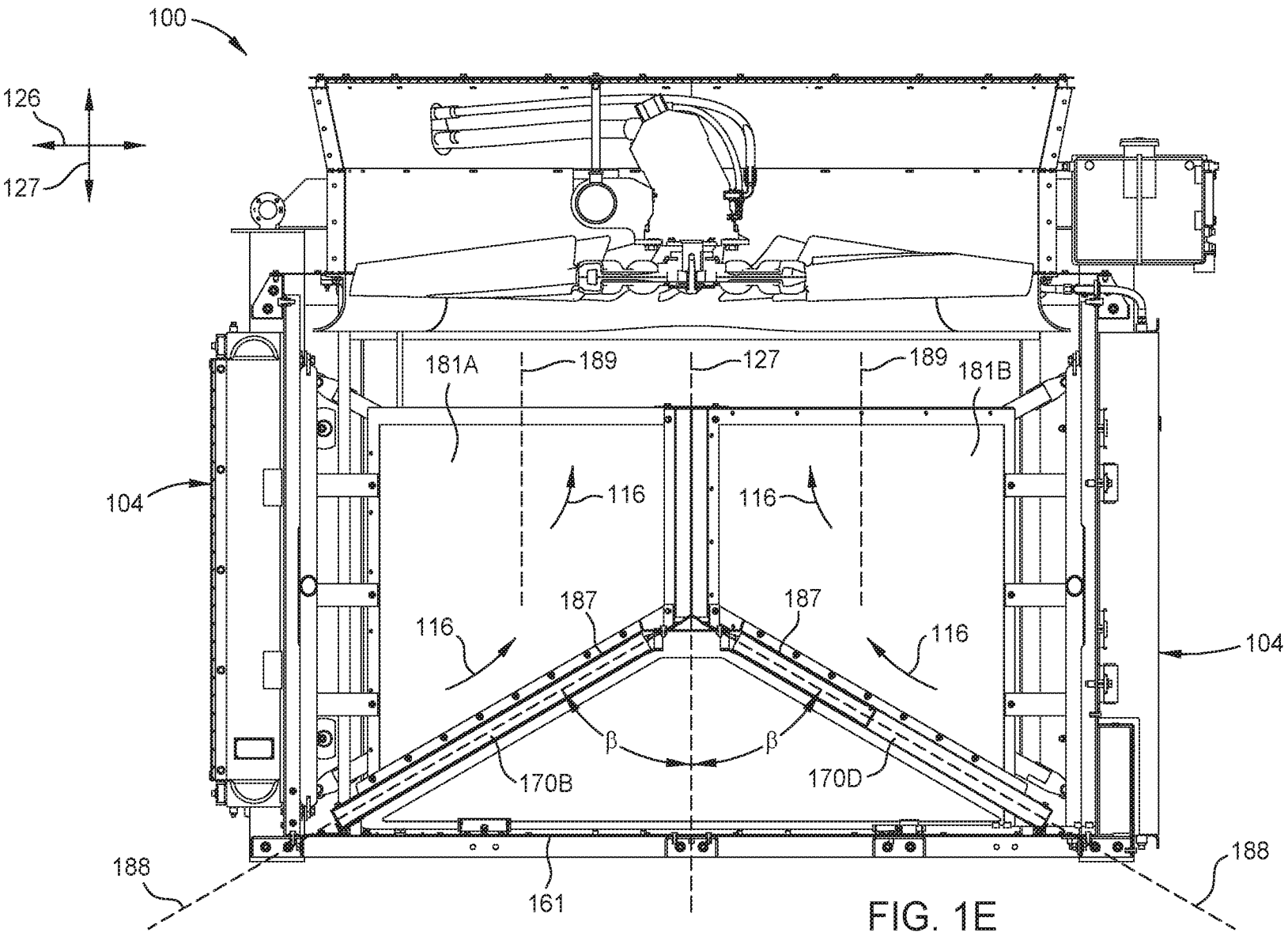
FIG. 1E is a partial schematic side view of the heat exchanger unit illustrated in FIG. 1A, according to one implementation.

FIG. 1E is a partial schematic side view of the heat exchanger unit 100 illustrated in FIG. 1A, according to one implementation. The panels of the first set of panels 170A-170D are angled upwards and towards the vertical axis 127 that extends through the center 191 of the frame 102. The panels 170A-170D are angled upwards and towards the center 191 of the frame 102. The panels of the first set of panels 170A-170D each include a center axis 188 between the vertical axis 127 and the horizontal axis 126. The center axis 188 of each panel of the first set of panels 170A-170D intersects the vertical axis 127 of the heat exchanger unit 100 at an angle $\beta$. The angle $\beta$ is within a range of 10 degrees to 40 degrees, such as 15 degrees to 35 degrees. In one embodiment, which can be combined with other embodiments, the angle $\beta$ is within a range of 20 degrees to 30 degrees. In one example, the angle $\beta$ is 30 degrees. In one example, the angle $\beta$ is 20 degrees.

The angle β values discussed above facilitate uniform airflow through, and thermal efficiency of, the heat exchanger unit 100 while promoting noise absorption.

The panels of the second set of panels 181A-181D of the vertical curtain 180 each include a vertical center axis 189 that is parallel to the vertical axis 127 of the heat exchanger unit 100. Each panel of the second set of panels 181A-181D includes an angled bottom end 187 that is parallel to the center axis 188 of the respective panel of the first set of panels 170A-170D disposed below the second set of panels 181A-181D.

The panels 170A-170D, 181A-181D at least partially block air 116 that is attempting to pass therethrough. The panels 170A-170D, 181A-181D may include sound absorbing material disposed therein, such as a mineral wool material. The panels 170A-170D, 181A-181D reduce noise generated by the heat exchanger unit 100, such as noise generated by the fan 108 that would otherwise reflect off of the floor 161 or other components of the heat exchanger unit 100. The angled profile of each of the first set of panels 170A-170D facilitates directing air towards the center 191 of the frame 102 and upwards towards the fan 108. The vertical profile of each of the second set of panels 181A-181D of the vertical curtain 180 facilitates directing air towards the center 191 of the frame 102 and upwards towards the fan 108.

The configurations described above reduce or eliminate the formation of dead zones of air 116 towards the floor 161, or bottom, of the heat exchanger unit 100. The configurations described above also reduce the stratification effect of air flow, where significantly more air flows into the heat exchanger unit near a top than near the floor. The reduced occurrences of dead zones and reduced stratification of air flow facilitate a more efficient use of a surface area of the cores 106 of the coolers 104 for heat exchanging.

The configurations described above also facilitate more uniform flow of air 116 into and through the internal volume 168 of the heat exchanger unit 100. By promoting the surface area of cores 106 used and the uniform flow of air 116 through the heat exchanger unit 100, the configurations described above facilitate heat exchanging efficiency of the heat exchanger unit 100 and prevent equipment, such as a frac pump, from overheating. This is especially useful for when the heat exchanger unit 100 operates at high altitudes or low ambient temperatures. The configurations described above also facilitate reducing the sound emitted by the heat exchanger unit 100, making the heat exchanger unit 100 especially suitable for operation in noise-sensitive areas.

Aspects described herein provide benefits compared to other heat exchanger designs in that the aspects described herein result in more sound reduction, such as a 3 dBC larger sound reduction, with more uniform air flow therethrough.

Benefits of the present disclosure include increased sound reduction, increased heat exchange capacity and thermal efficiency, reduced or eliminated stratification, more efficient use of surface area of coolers for heat transfer, increased and more uniform air flow through heat exchanger units, and achieving such benefits for current heat exchanger designs.

Aspects of the present disclosure include a first set of angled panels; a second set of vertical panels; a vertical curtain (such as the vertical curtain 180) that includes a set of vertical panels (such as the second set of panels 181A-181D); an angle of intersection between a vertical axis and a first set of angled panels; a sound absorbing material in a first set of panels and a second set of panels; and a sound barring material and a vertical curtain disposed at a distance from a bottom surface of an aeroring. It is contemplated that one or more of these aspects disclosed herein may be combined. Moreover, it is contemplated that one or more of these aspects may include some or all of the aforementioned benefits.

While the foregoing is directed to embodiments of the present disclosure, other and further embodiments of the disclosure may be devised without departing from the basic scope thereof. The present disclosure also contemplates that one or more aspects of the embodiments described herein may be substituted in for one or more of the other aspects described. The scope of the disclosure is determined by the claims that follow.

We claim:

1. A heat exchanger unit, comprising:

a frame having a plurality of side regions and at least one cooler associated with at least one of the plurality of side regions;

a vertical axis;

an internal volume;

a floor;

a fan disposed above the floor to move air through the internal volume;

a first set of panels disposed within the frame between the floor and the fan, wherein the first set of panels is mounted to one or more of the floor or the frame; and a vertical curtain disposed between the first set of panels and the fan, wherein each panel of the first set of panels comprises a mesh panel and a panel frame having a matting enclosed therein, the vertical curtain comprises a mesh panel, and the vertical curtain is directly mounted to the first set of panels.

2. The heat exchanger unit of claim 1, wherein the vertical curtain extends upwards from the first set of panels and towards the fan.

3. The heat exchanger unit of claim 1, wherein the first set of panels comprises four panels disposed in a pyramidal arrangement, and each of the four panels of the first set of panels includes a center axis that intersects the vertical axis of the heat exchanger unit at an angle.

4. The heat exchanger unit of claim 3, wherein the angle is within a range of 10 degrees to 40 degrees.

5. The heat exchanger unit of claim 3, wherein the vertical curtain comprises four panels extending vertically upwards from the first set of panels, and each of the four panels of the vertical curtain includes a vertical center axis that is parallel to the vertical axis of the heat exchanger unit.

6. The heat exchanger unit of claim 5, wherein the four panels of the vertical curtain extend radially outwardly from a center of the frame, and the four panels of the vertical curtain are disposed equidistantly from each other in a horizontal plane.

7. A heat exchanger unit, comprising:

a frame having a plurality of side regions and at least one cooler associated with at least one of the plurality of side regions;

a vertical axis;

an internal volume;

a floor;

a fan disposed above the floor to move air through the internal volume, the fan having one or more blades;

a fan cylinder assembly having an aeroring, the aeroring having a bottom surface;

a first set of panels disposed within the frame between the floor and the fan; and a vertical curtain disposed between the first set of panels and the fan, the vertical curtain having a top end that is disposed at a distance from the bottom surface of the aeroring, wherein the first set of panels comprises four panels disposed in a pyramidal arrangement, and each of the four panels of the first set of panels includes a center axis that intersects the vertical axis of the heat exchanger unit at an angle.

8. The heat exchanger unit of claim 7, wherein the distance is within a range of 0.1 inches to 3.0 inches.

9. The heat exchanger unit of claim 7, wherein the angle is within a range of 10 degrees to 40 degrees.

10. The heat exchanger unit of claim 7, wherein the vertical curtain comprises four panels extending vertically upwards from the first set of panels, and each of the four panels of the vertical curtain includes a vertical center axis that is parallel to the vertical axis of the heat exchanger unit.

11. The heat exchanger unit of claim 7, wherein the four panels of the vertical curtain extend radially outwardly from a center of the frame, and the four panels of the vertical curtain are disposed equidistantly from each other in a horizontal plane.

12. The heat exchanger unit of claim 7, wherein the first set of panels is mounted to one or more of the floor or the frame, and the vertical curtain is mounted to one or more of the first set of panels or the frame.

13. The heat exchanger unit of claim 1, wherein the vertical curtain comprises a second set of panels disposed above the first set of panels and below the fan, each one of the second set of panels extending vertically from the first set of panels.

14. The heat exchanger unit of claim 13, wherein each one of the first set of panels is angled upward and towards a center of the frame to direct at least part of the air moving through the internal volume upward and toward the center of the frame.

15. The heat exchanger unit of claim 14, wherein the first set of panels is mounted to one or more of the floor or the frame, and the second set of panels is mounted to one or more of the first set of panels or the frame.

16. The heat exchanger unit of claim 15, wherein the second set of panels comprises four panels, and each of the four panels of the second set of panels includes a vertical center axis that is parallel to the vertical axis of the heat exchanger unit.

17. The heat exchanger unit of claim 16, wherein the four panels of the second set of panels extend radially outwardly from the center of the frame, and the four panels of the second set of panels are disposed equidistantly from each other in a horizontal plane.

18. A heat exchanger unit, comprising:

a frame having a plurality of side regions and at least one cooler associated with at least one of the plurality of side regions;

a vertical axis;

an internal volume;

a floor;

a fan disposed above the floor to move air through the internal volume;

a first set of panels disposed within the frame between the floor and the fan, wherein the first set of panels comprises four panels disposed in a pyramidal arrangement, and each of the four panels of the first set of panels includes a center axis that intersects the vertical axis of the heat exchanger unit at an angle; and a vertical curtain disposed between the first set of panels and the fan.

19. The heat exchanger unit of claim 18, wherein the vertical curtain comprises four panels extending vertically upwards from the first set of panels, and each of the four panels of the vertical curtain includes a vertical center axis that is parallel to the vertical axis of the heat exchanger unit.

20. A heat exchanger unit, comprising:

a frame having a plurality of side regions and at least one cooler associated with at least one of the plurality of side regions;

a vertical axis;

an internal volume;

a floor;

a fan disposed above the floor to move air through the internal volume;

a first set of panels disposed within the frame between the floor and the fan, wherein the first set of panels comprises four panels disposed in a pyramidal arrangement, and each of the four panels of the first set of panels includes a center axis that intersects the vertical axis of the heat exchanger unit at an angle; and a vertical curtain disposed between the first set of panels and the fan, wherein each panel of the first set of panels comprises a mesh panel and a panel frame having a matting enclosed therein, and the vertical curtain comprises a mesh panel.

21. The heat exchanger unit of claim 20, wherein the angle is within a range of 10 degrees to 40 degrees.

22. The heat exchanger unit of claim 20, wherein the vertical curtain comprises four panels extending vertically upwards from the first set of panels, and each of the four panels of the vertical curtain includes a vertical center axis that is parallel to the vertical axis of the heat exchanger unit.

23. The heat exchanger unit of claim 22, wherein the four panels of the vertical curtain extend radially outwardly from a center of the frame, and the four panels of the vertical curtain are disposed equidistantly from each other in a horizontal plane.

* * * * *